US007582048B2

(12) United States Patent
Chen

(10) Patent No.: US 7,582,048 B2
(45) Date of Patent: Sep. 1, 2009

(54) FABRIC FOLDING MACHINE STRUCTURE

(75) Inventor: Wan-Yih Chen, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 596 days.

(21) Appl. No.: 11/392,879

(22) Filed: Mar. 30, 2006

(65) Prior Publication Data

US 2007/0228087 A1 Oct. 4, 2007

(51) Int. Cl.
*B31F 7/00* (2006.01)

(52) U.S. Cl. ..... 493/413; 493/415; 493/430; 493/433; 270/30.01; 270/39.01; 270/39.05

(58) Field of Classification Search ..... 493/413, 493/411, 415, 430, 433; 270/30.01, 39.01, 270/39.05

See application file for complete search history.

(56) References Cited

U.S. PATENT DOCUMENTS 3,913,904 A * 10/1975 Occhetti ..... 270/30.04
4,074,901 A * 2/1978 Catallo ..... 493/413
6,514,186 B2 * 2/2003 Catallo ..... 493/414
6,857,629 B2 * 2/2005 Fritz et al. ..... 270/30.01
6,949,060 B2 * 9/2005 Lenk ..... 493/424
7,401,771 B2 * 7/2008 Steyer ..... 270/30.01

FOREIGN PATENT DOCUMENTS

TW 280327 7/1996
TW 441612 6/2001
TW 490520 6/2002

* cited by examiner

*Primary Examiner*—Hemant M Desai
(74) *Attorney, Agent, or Firm*—Muncy, Geissler, Olds & Lowe, PLLC

(57) ABSTRACT

A fabric folding machine structure is used for receiving and folding a fabric woven by a circular knitting machine. A fabric folding machine is added to the circular knitting machine without changing the length, width, and height of the fabric rolling machine. The fabric folding machine has a carrying base for carrying the fabric, and both ends of the carrying base are fixed to the bottom of two side seats, and a plurality of fabric rolling rods disposed between the two side seats define a carrying space, and the two side seats include a fabric folding unit for driving the fabric on the carrying base, and the fabric folding unit can drive the fabric back and forth in the carrying space to fold the fabric on the carrying base, so as to provide a larger carrying space and a higher fabric storing capacity than a prior art fabric folding machine.

8 Claims, 6 Drawing Sheets

FABRIC FOLDING MACHINE STRUCTURE

FIELD OF THE INVENTION

The present invention relates to a structure for folding fabrics, and more particularly to a fabric folding machine structure for synchronously receiving and folding fabrics woven by a circular knitting machine.

BACKGROUND OF THE INVENTION

At present, most of the general fabric folding machines used in the industry adopt a fabric rolling structure of a circular knitting machine and change or add a fabric folding machine structure for receiving and folding fabrics, so as to achieve an industrial uniformity and the value of a multifunctional product. In the technical area of the present invention, three issued patents related to a fabric folding mechanism of a circular knitting machine are cited for reference as follows:

1. R.O.C. Pat. Publication No. 00280327 entitled "Fabric folding machine" is hereinafter referred to as "Prior Art 1".

2. R.O.C. Pat. Publication No. 00441612 entitle "Improved fabric folding machine structure" is hereinafter referred to as "Prior Art 2".

3. R.O.C. Pat. Publication No. 00490520, entitled "Large circular knitting fabric folding apparatus having the functions of synchronously adjusting the tension of rolled fabrics, folding fabrics and rolling fabrics" is hereinafter referred to as "Prior Art 3".

The abstract of the Prior Art 1 describes "a fabric folding machine uses a driving rod of a rotary disc of a knitting machine to transmit kinetic energy from a belt to a pressure disc, and a transmission axle of the pressure disc is engaged with a gear, and the gear drives a driven axle, and the driven gear of the driven axle drives a rotary rod for periodic movements. With the periodic movements of the rotary rod, a fabric folding board can be moved back and forth regularly and displaced by the guiding of the rotary rod. Due to the back and forth movements of the fabric folding board, woven fabrics are stacked naturally to replace the traditional roller for rolling fabrics that may cause loosened fabrics due to the pulling of the edges of the fabrics."

The abstract of the Prior Art 2 describes "an improved fabric folding machine structure, particularly to a design of a fabric folding machine that can change speed to produce stepless speed changes according to the speed of removing fabrics, and the fabric folding machine comprises a primary bevel gear disposed at the center of a lower fixed base, and the fixed base is pivotally coupled to a rotary base for carrying the whole fabric folding machine mechanism, and an output axle installed in the rotary base includes a driven bevel gear engaged with the primary bevel gear, so that when the body of the fabric folding machine is rotated with the knitting machine, the driven bevel gear and the primary bevel gear will move correspondingly, and a sprocket and a chain of the output axle drive a stepless variable speed input axle which is on a side of the rotary base, such that the stepless variable speed input axle rotates at a specific speed, and drives a sprocket module through a vertical transmission mechanism, and a chain installed in the sprocket module includes a connector having a central hole and moving according to the movements of the chain. Further, the internal sides of two sideboards constituting the fabric folding machine include a set of fixing boards, and a set of sliding tracks are secured onto rectangular holes of the fixing boards by screws, and a fabric folding board is installed between two sliding tracks and each installs at least one pulley capable of sliding in the set of sliding tracks. In the meantime, a sliding board disposed at the bottom of the fabric folding board can slide sideway. The sliding board includes pulleys separately disposed on both sides of the sliding board and embedded into both sides of a set of guiding rods installed at a guiding seat on the bottom surface of the fabric folding board, so that the sliding board can be slid to the right or left of the fabric folding board within an appropriate range. The sliding board includes a connecting pillar disposed at the bottom of the sliding board and inserted into a connecting hole of a connector on the chain, such that when the whole fabric folding machine drives a rotary base to rotate and the output axle uses a stepless variable speed machine to drive the chain to produce periodic movements, the connector drives the sliding board to slide the fabric folding board back and forth horizontally, so as to stack the fabrics neatly on the fabric folding board. The stepless variable speed machine comes with the characteristics of having stepless variable speed and retarding the rotary speed to zero, so that it can change the speed of sliding the fabric folding board back and forth according to the speed of unloading the fabrics and the rotary speed of the knitting machine. The invention can achieve the best effect for receiving and folding fabrics and thus complying with the requirements for a patent application."

The abstract of the Prior Art 3 describes "A large circular knitting fabric folding apparatus having the functions of synchronously adjusting the tension of rolled fabrics, folding fabrics and rolling fabrics includes a primary transmission axle disposed on a transmission box of a machine body, and a chain engages a secondary transmission axle of the gear box with the primary transmission axle to drive a cam disc on the gear box to rotate. With the link rods disposed in a guiding track of the cam disc and pivotally coupled to the machine, the preinstalled tracks can be rotated and moved periodically, and the guidance of the link rod can drive the fabric folding board to displace back and forth regularly. A cable is wound onto two swinging arms and pulleys on the machine box. The foregoing structure of the invention can achieve the effect of synchronously adjusting the tension of rolling the fabrics and the device for concurrently rolling and folding fabrics."

Referring to FIG. 1 for the schematic planar view of a prior art fabric folding machine, the abstracts of Prior Arts 1, 2 and 3 clearly show that the main technical measures of the prior art use a link mechanism 16' and a link rod 161' to indirectly drive the carrying base 12' to move, so that the carrying base 12' can use a sliding channel 121' separately disposed on both sides of the carrying base 12' to horizontally slide back and forth on the sliding track 112' of the side seats 11' to naturally let the fabrics be folded and stacked onto the carrying base 12' of the fabric folding machine 10'.

In summation of the descriptions above, these prior arts have same existing problems as follows:

1. Since the carrying base 12' of the prior arts requires sufficient space under the carrying base 12' to achieve the back and forth movements and install the link mechanism 16' and sliding track 112', the position for installing the carrying base 12' must be higher, and thus relatively reducing the carrying space 30' for folding fabrics on the carrying base 12'.

2. If it is necessary to increase the carrying space 30' for folding fabrics on the carrying base 12', the side seats 11' must be added at the top, the transmission rod 111' must be elongated, and the fabric rolling rod 13' is moved upward, and such changes will affect the shape of a connecting element (not shown in the figure) disposed between the fabric folding machine 10' and the circular knitting machine, and thus requiring a new design which is not cost-effective.

3. Since these prior arts slide the carrying base 12' back and forth horizontally on the sliding track 112', therefore the size of the folded fabric must be smaller than one half of the length of the sliding track 112'. In other words, these prior art fabric folding machines 10' can only fold a fabric 40 with the size of a half fold and cannot fold a fabric 40 with the size of a full fold which is equal to the length of the sliding track 112'.

The problems of the foregoing prior art fabric folding machine are the problems existing in the industry and cannot be solved effectively, and thus such problems demand immediate attention and feasible solutions.

SUMMARY OF THE INVENTION

Therefore, it is a primary objective of the present invention to overcome the foregoing shortcomings of the prior art and avoid existing problems, and the present invention is applied for a fabric rolling machine structure of a circular knitting machine without changing the length, width and height of the fabric rolling machine to add a fabric folding machine structure for receiving and folding a fabric. The fabric folding machine structure of the invention can fold the fabrics woven by the circular knitting machine into the size of a full fold. Compared with the prior art fabric folding machine, the present invention provides a larger carrying space and a higher fabric storing capacity.

To achieve the foregoing objective, a fabric folding machine structure of the invention includes a carrying base for carrying the fabrics, and both ends of the carrying base are fixed to the bottom of the two side seats, and a plurality of fabric rolling rods are disposed between the two side seats to define a carrying space; characterized in that The two side seats in the carrying space include a fabric folding unit capable of driving fabrics to move back and forth, and be received and folded on the carrying base.

A preferred embodiment and technical contents of the present invention are described with accompanied drawings as follows.

DETAILED DESCRIPTION OF THE PREFERRED EMBODIMENTS

Figure 2:
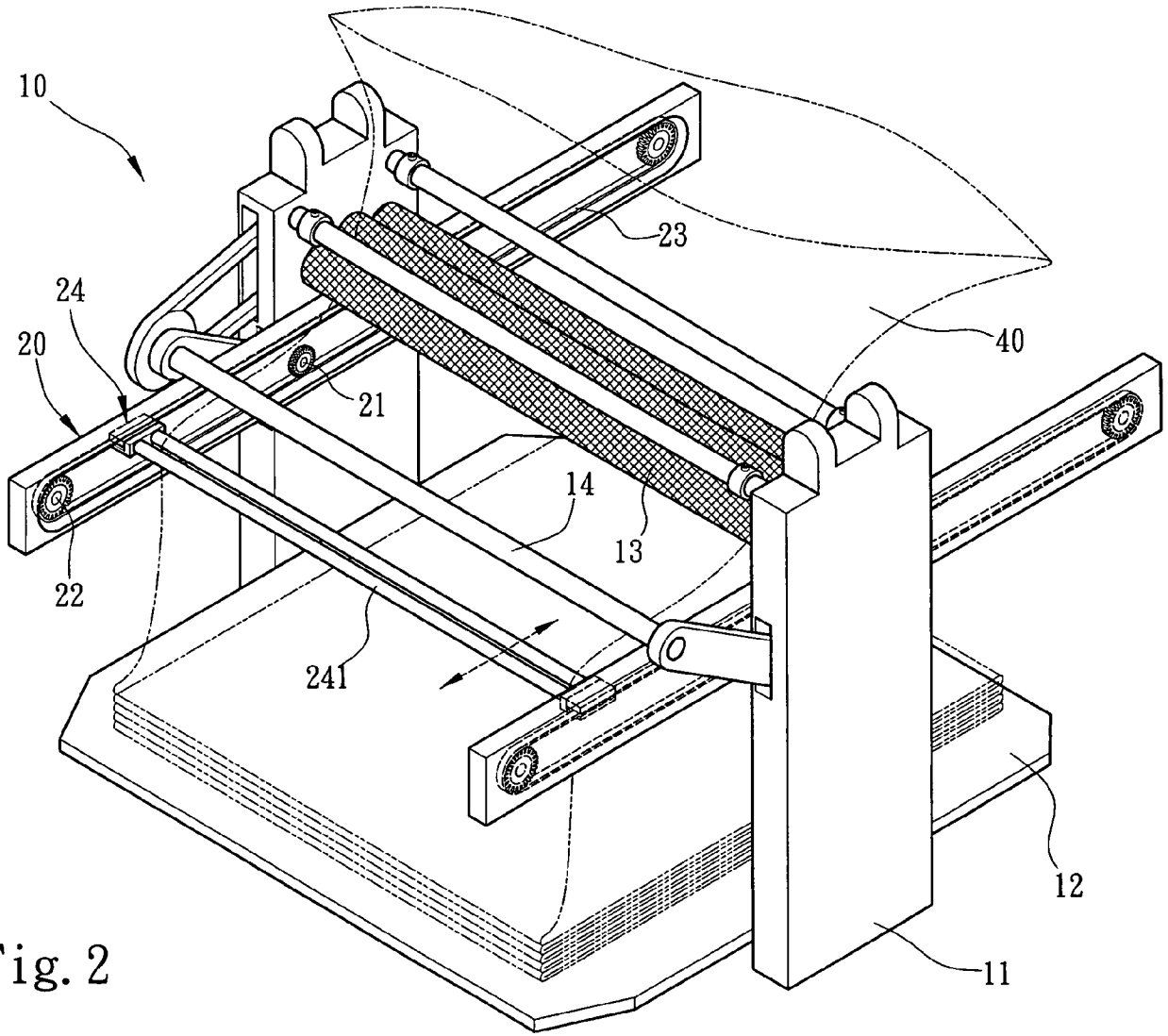
FIG. 2 is a pictorial drawing of a fabric folding machine structure of the present invention.
Figure 3:
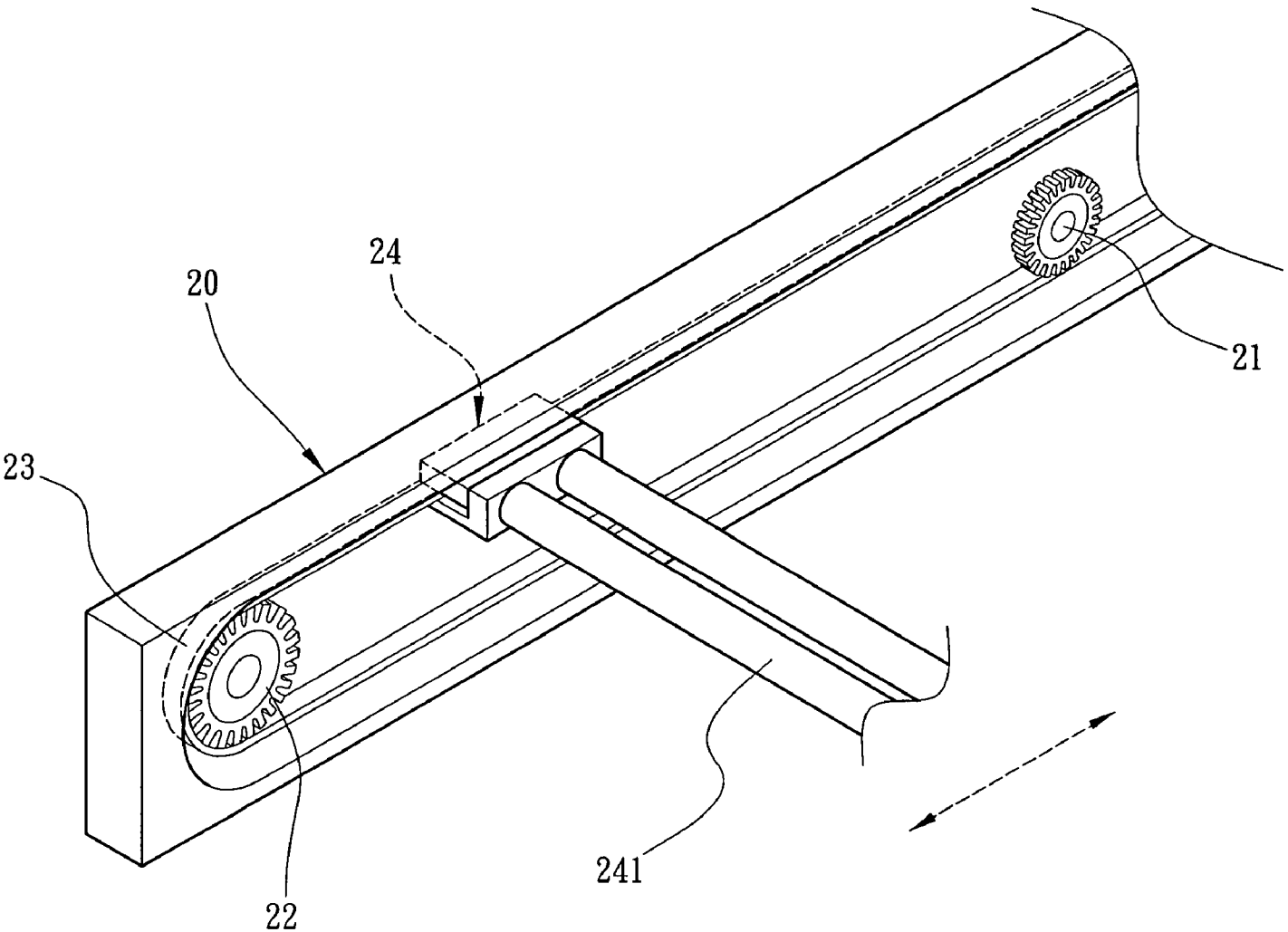
FIG. 3 is a partial pictorial drawing of a fabric folding unit as depicted in FIG. 2.

The present invention will now be described in more detail hereinafter with reference to the accompanying drawings as follows:

Referring to FIGS. 2 and 3 for the pictorial drawings of a fabric folding machine structure of the present invention and a portion of a fabric folding unit of the present invention respectively, the structure of the fabric folding machine 10 of the invention is applied for a mechanical structure for folding a fabric 40 woven by a circular knitting machine (not shown in the figure), and the fabric folding machine 10 includes a carrying base 12 for carrying the fabric 40, and both ends of the carrying base 12 are fixed to the bottom of two side seats 11, and the upper end between the two side seats 11 includes a plurality of fabric rolling rods 13 for receiving and rolling flat a fabric 40 woven by the circular knitting machine. In addition, the two side seats 11 disposed on a lateral side of the fabric folding machine 10 include a fabric rolling rod 14 for receiving and rolling the fabric 40, and the connecting relation of the foregoing structure defines a carrying space 30; and the two side seats 11 in the carrying space 30 include a fabric folding unit 20 for driving the fabric 40 to be received and folded on the carrying base 12, and the fabric folding unit 20 includes a driving member 21 and two driven members 22, wherein the driving member 21 (such as a gear or a synchronous gear) is driven by a servomotor or a stepping motor, and coupled to the two driven members 22 (such as a gear or a synchronous gear) by a connecting member 23 (such as a chain or a synchronous belt). Further, the connecting member 23 includes a driving module 24 installed between the two driven members 22, and the driving module 24 installs two fabric guiding rods 241 (such as axially rotated circular rods), and the two fabric guiding rods 241 can limit the position of a fabric 40, and the driving member 21 drives the driving module 24 to displace linearly, so that the fabric 40 is displaced back and forth in the carrying space 30 and received and folded on the carrying base 12 to achieve the effect of receiving and folding the fabric 40 into the size of a full fold.

Figure 4A:
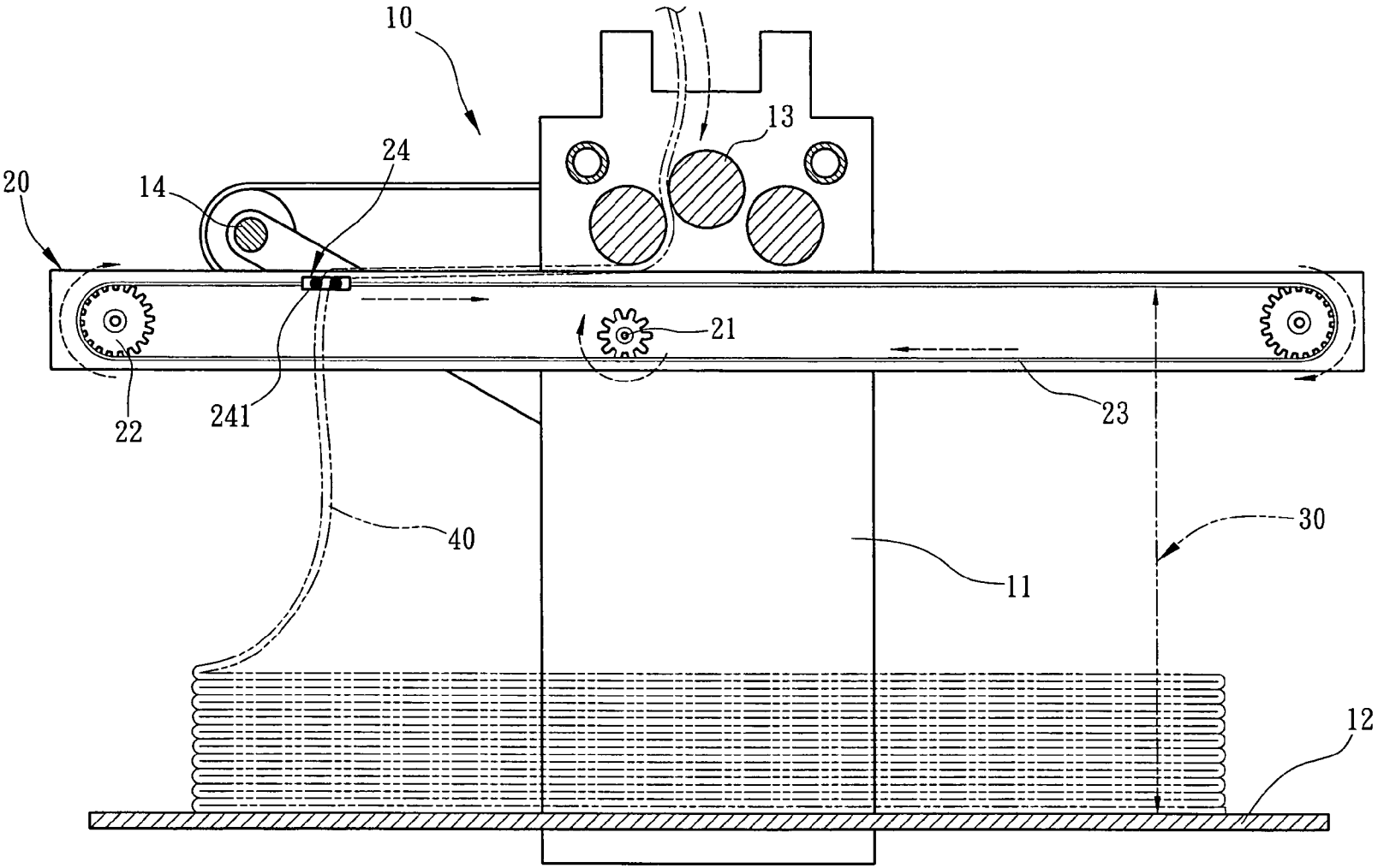
FIGS. 4A to 4C are schematic views of the operating movements of a fabric folding machine structure of the present invention.
Figure 4B:
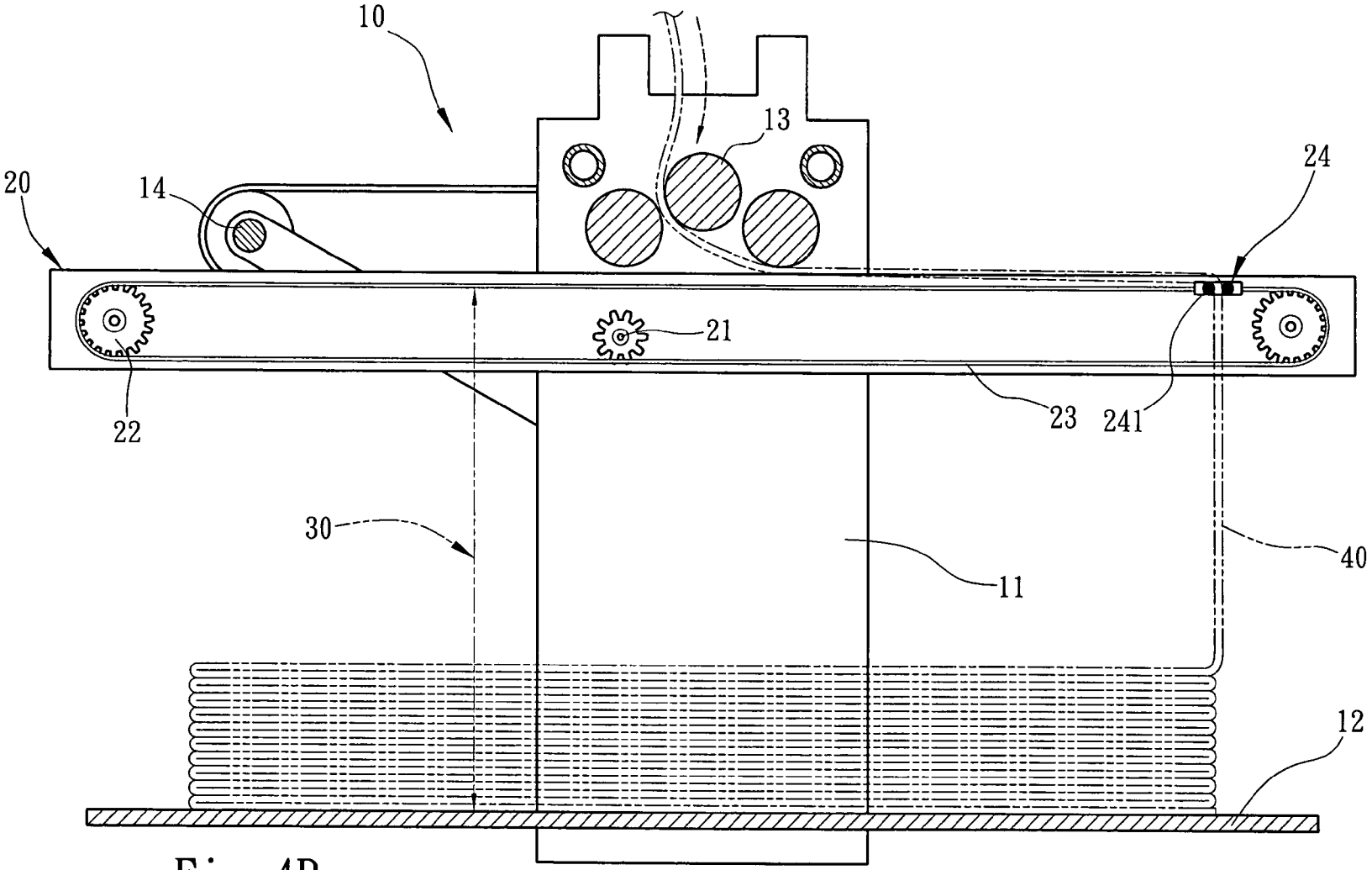
Figure 4C:
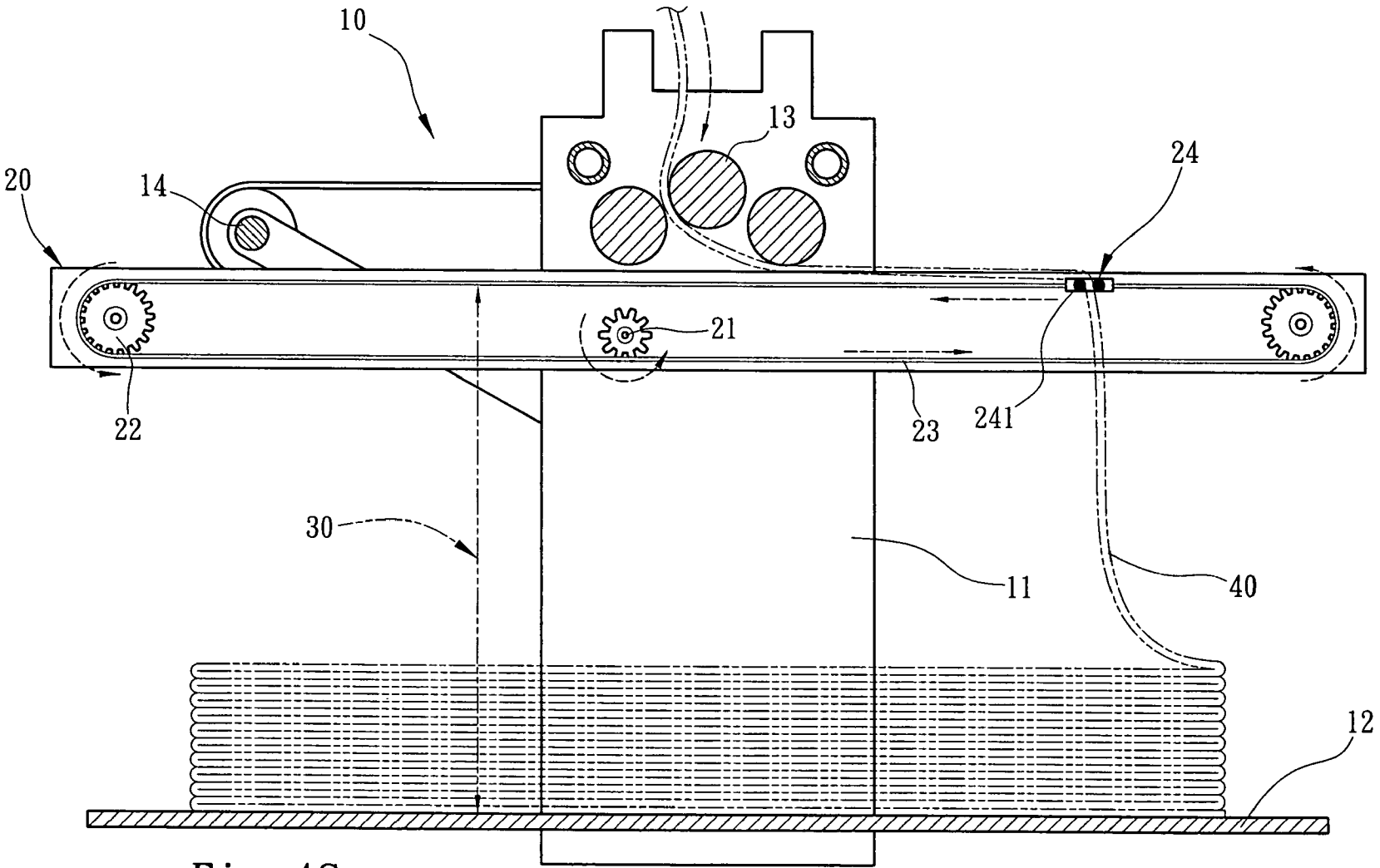

To make it easy for our examiners and readers to understand the operating movements of the fabric folding machine structure of the present invention, FIGS. 4A, 4C are provided as the schematic views of the operating movements of the fabric folding machine structure. In the structure of the fabric folding machine 10 as shown in FIG. 4A, the driving member 21 driven by a servomotor or a stepping motor rotates the fabric folding unit 20 clockwise. Since the bottom of the driving member 21 is coupled to the connecting member 23, therefore the connecting member 23 is driven to move, and the connecting member 23 is coupled to the two driven members 22 on both left and right sides, and the two driven members 22 can be rotated clockwise simultaneously and synchronously. Further, the driving module 24 on the connecting member 23 moves the fabric woven by the circular knitting machine to displace to the right side by the guiding of the connecting member 23. In FIG. 4B, the driving module 24 reaches the utmost right side, and the driving member 21 driven by the servomotor or stepping motor stops rotating to naturally form a folded angle. In FIG. 4C, the driving member 21 is driven by the servomotor or stepping motor in an opposite direction to rotate counterclockwise. As described above, the bottom of the driving member 21 is coupled to the connecting member 23 and thus driving the connecting member 23 to move. Since the connecting member 23 is coupled to the two driven members 22 on both left and right sides, and the two driven members 22 are rotated counterclockwise simultaneously and synchronously, and the driving module 24 on the connecting member 23 will be guided by the connecting member 23 to clamp the fabric 40 woven by the circular knitting machine to linearly displace to the right side, so that the fabric 40 is moved back and forth in the carrying space 30 and received and folded on the carrying base 12, so as to receive and fold the fabric 40 in the size of a full fold.

Figure 1:
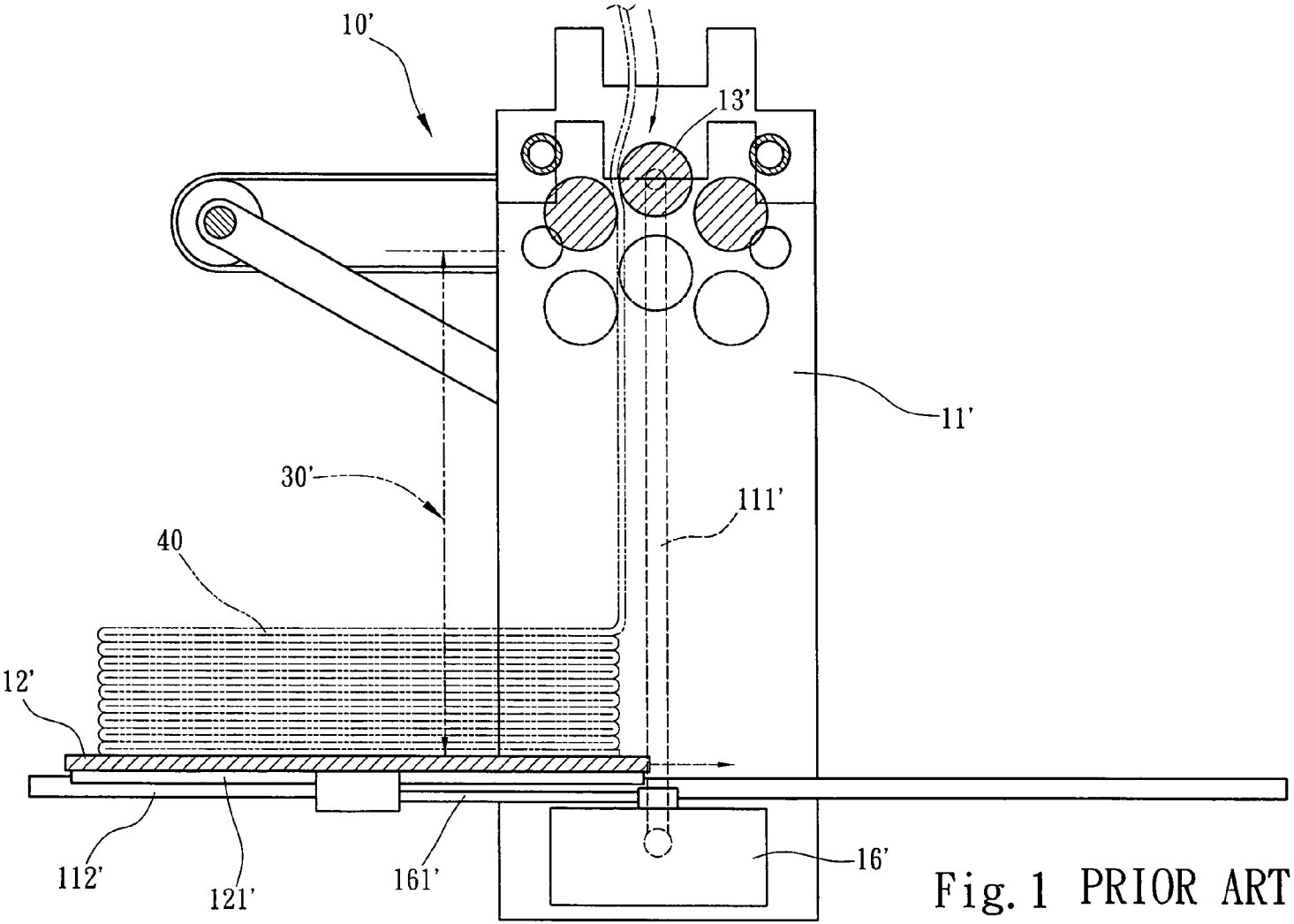
Fig. 1 PRIOR ART
FIG. 1 is a schematic planar view of a prior art fabric folding machine.

To clearly show that the present invention needs not to change the size of the fabric rolling machine (not shown in the figure) of a traditional circular knitting machine for designing the structure of a fabric rolling machine (not shown in the figure) that has a larger fabric storing capacity than the fabric folding machine 10', the planar view of a fabric folding machine 10 of the invention (as shown in FIG. 4A) is compared with the planar view of the fabric folding machine 10' (as shown in FIG. 1). From these two figures, the prior art fabric folding machine 10' includes a link mechanism 16' and a sliding track 112' under the carrying base 12'. To increase the carrying space 30' for folding fabrics 40 on the carrying base 12', the side seats 11' are enlarged, the transmission rod 111' is elongated, and the fabric rolling rod 13' is moved upward to obtain a carrying space 30 similar to the structure of the fabric folding machine 10 according to the present invention. Since the carrying base 12' of the prior art fabric folding machine 10' has to slide back and forth horizontally on the sliding track 112' to fold the fabric 40 into the size of a half fold. Therefore, the fabric 40 folded into a full fold by the structure of the fabric folding machine 10 according to the present invention definitely has a larger fabric storing capacity.

While the invention has been described by means of specific embodiments, numerous modifications and variations could be made thereto by those skilled in the art without departing from the scope and spirit of the invention set forth in the claims.

What is claimed is:

1. A fabric folding machine structure, used for receiving and folding a fabric woven by a circular knitting machine, and said fabric folding machine including a carrying base for carrying said fabric, and both ends of said carrying base being coupled to the bottom of two side seats, and a plurality of fabric rolling rods being disposed between said two side seats for defining a carrying space, characterized in that:

said two side seats in said carrying space including a fabric folding unit for driving said fabric to move back and forth on said carrying base;

wherein said fabric folding unit includes a driving member and two driven members, and said driving member is between said two driven members and coupled to said two driven members by a connecting member, and said connecting member installs a driving module disposed between said two driven members for limiting the position of said fabric, and said driving member drives said fabric to move back and forth in said carrying space and be received and folded onto said carrying base; and wherein said fabric folding machine includes a fabric rolling rod separately disposed on the lateral sides of said two side seats for rolling said fabric.

2. The fabric folding machine structure of claim 1, wherein said driving module includes a fabric guiding rod for limiting the position of said fabric.

3. The fabric folding machine structure of claim 2, wherein said fabric guiding rod is comprised of two axially rotated circular rods.

4. The fabric folding machine structure of claim 1, wherein said driving member is driven by a servomotor or a stepping motor.

5. The fabric folding machine structure of claim 4, wherein said driving member is a gear.

6. The fabric folding machine structure of claim 5, wherein said driven member is a gear and said connecting member is a chain.

7. The fabric folding machine structure of claim 4, wherein said driving member is a synchronous gear.

8. The fabric folding machine structure of claim 7, wherein said driven member is a synchronous gear and said connecting member is a synchronous belt.

* * * * *